US010568427B2

(12) United States Patent
Kruger

(10) Patent No.: US 10,568,427 B2
(45) Date of Patent: Feb. 25, 2020

(54) FASTENING FITTING FOR A DRAWER FRONT ON AN OPEN SIDE OF A DRAWER

(71) Applicant: Wolfgang Held, Hard, Österreich (AT)

(72) Inventor: Erwin Kruger, Remseck (DE)

(73) Assignee: Wolfgang Held, Osterreich (DE)

( * ) Notice: Subject to any disclaimer, the term of this patent is extended or adjusted under 35 U.S.C. 154(b) by 361 days.

(21) Appl. No.: 15/500,099

(22) PCT Filed: Jul. 30, 2015

(86) PCT No.: PCT/EP2015/001565
§ 371 (c)(1),
(2) Date: Jan. 30, 2017

(87) PCT Pub. No.: WO2016/015865
PCT Pub. Date: Feb. 4, 2016

(65) Prior Publication Data

US 2017/0265645 A1 Sep. 21, 2017

(30) Foreign Application Priority Data

Jul. 30, 2014 (DE) ..... 10 2014 011 090

(51) Int. Cl.
*A47B 88/00* (2017.01)
*A47B 88/956* (2017.01)
(Continued)

(52) U.S. Cl.
CPC ..... *A47B 88/956* (2017.01); *A47B 88/941* (2017.01); *A47B 2088/954* (2017.01)

(58) Field of Classification Search
CPC ..... A47B 88/95; A47B 2088/951; A47B 2088/952; A47B 2088/953; A47B 2088/954; A47B 2088/955
(Continued)

(56) References Cited

U.S. PATENT DOCUMENTS 4,850,659 A * 7/1989 Rock ..... A47B 88/956 312/263
5,222,791 A * 6/1993 Held ..... A47B 88/00 312/348.4
(Continued)

FOREIGN PATENT DOCUMENTS

| | | | |
|---|---|---|---|
| DE | 20 2012 010755 | U1 | 2/2014 |
| DE | 20 2014 002229 | U1 | 4/2014 |
| EP | 0439748 | A2 | 8/1991 |
| WO | WO 2012/159139 | A1 | 11/2012 |

*Primary Examiner* — Joshua T Kennedy
(74) *Attorney, Agent, or Firm* — John Alumit

(57) ABSTRACT

A fastening fitting for a facing on an open side of a drawer having two facing fittings mounted on the back side of the facing and two connection fitting parts mounted, in the vicinity of the open face end of the drawer, on the side walls of the drawer. At least the vertical adjustment of the facing connected to the connection fitting parts is variable and lockable. The facing fittings are provided with a horizontally oriented coupling bolt spaced apart from the back side of the facing, which coupling bolts can be introduced into insertion receptacles of front fixation units that are mounted on the end of the side walls of the drawer. The front fixation units have vertical adjustment elements for varying the vertical adjustment of the insertion receptacles of the front fixation units and lateral adjustment elements for varying the horizontal lateral adjustment of the insertion receptacles of the front fixation units relative to the coupling bolts of the facing fittings. facing can be adjusted exactly in height and laterally/horizontally in a furniture carcass. The front fixation units are connectable via wooden casing adapters to wooden casing portions, which in the connected state, form the side walls of the drawer and are fixedly connected to the drawer bottom. The front fixation units are accommodated in a separate housing, and the housings are coverable by means of masking caps, which are flush with the outer cross sections of the wooden casing portions and the open face end
(Continued)

Figure 1:
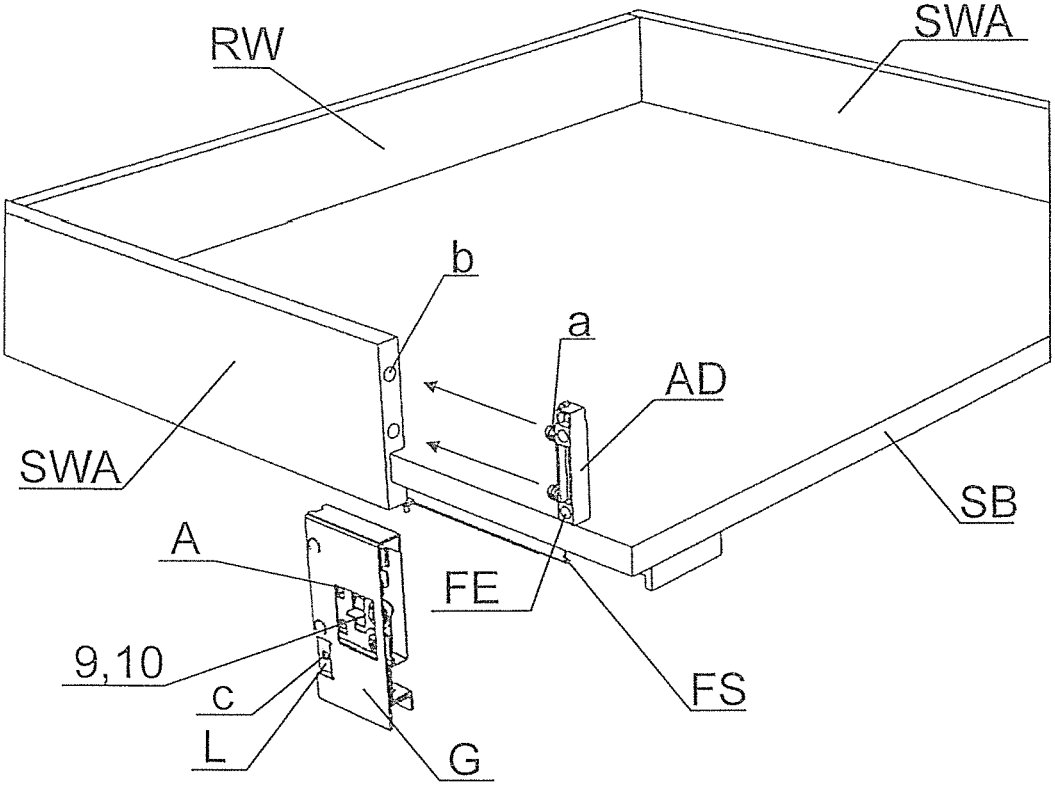

of the drawer. The front fixation units are connected via the housings to the side edges, facing toward one another, of the drawer bottom. The vertical adjustment elements and the lateral adjustment elements are accessible via recesses in the housings.

2 Claims, 8 Drawing Sheets

(51) Int. Cl.
*A47B 88/90* (2017.01)
*A47B 88/95* (2017.01)

(58) Field of Classification Search
USPC ..... 312/348.1
See application file for complete search history.

(56) References Cited

U.S. PATENT DOCUMENTS 5,860,718 A * 1/1999 Brustle ..... A47B 88/95
312/330.1
8,297,724 B2 * 10/2012 Hammerle ..... A47B 88/956
312/265.5
8,801,123 B2 * 8/2014 Kueng ..... A47B 88/956
312/348.4
8,955,929 B2 * 2/2015 Holzapfel ..... A47B 88/956
312/348.4
9,033,436 B2 * 5/2015 Holzapfel ..... A47B 88/956
312/348.4
9,386,848 B2 * 7/2016 Holzapfel ..... A47B 88/95
9,464,652 B2 * 10/2016 Holzapfel ..... F16B 12/02

* cited by examiner

FASTENING FITTING FOR A DRAWER FRONT ON AN OPEN SIDE OF A DRAWER

The invention relates to a fastening fitting for a facing on an open side of a drawer, which fitting comprises two facing fittings mounted on the back side of the facing and two connection fittings mounted, in the vicinity of the open face end of the drawer, and at least the vertical adjustment of the facing connected to the connection fittings is variable and the position is lockable; the facing fittings are provided with a horizontally oriented coupling bolt spaced apart from the back side of the facing, which coupling bolts can be introduced into insertion receptacles of front fixation units which are mounted on the end of the side walls of the drawer, and the front fixation units have vertical adjustment elements for varying the vertical adjustment of the insertion openings of the front fixation units and lateral adjustment elements for varying the horizontal lateral adjustment of the insertion receptacles of the front fixation units relative to the coupling bolts of the facing fitting parts.

One such fastening fitting is known from DE 40 26 407 A1 and has a facing which on its back side has two suspension hooks, open at the bottom, as facing fittings. These suspension hooks can be suspended from horizontally protruding suspension bolts as connection fitting parts, which protrude from the outer sides of the side walls of the drawer in the vicinity of the open face end of the drawer. The vertical suspended position of the suspension hooks from the suspension bolts can be locked by means of clamping screws that can be screwed into the suspension hooks. This orientation of the facing on the open face end of the drawer is effected via the vertical adjustment of the facing fittings and connection fitting parts. With the clamping screws, an alignment of the facing can be achieved in which the drawer itself comprises two side walls, one back wall, and one drawer bottom, which are to be connected to a facing that is separate them.

A fastening fitting for a facing on an open face end of a drawer is also known which comprises two facing fittings, mounted on the back side of the facing, and two connection fitting parts, mounted in the vicinity of the open face end of the drawer; at least the vertical adjustment of the facing connected to the connection fitting parts is variable, and the adjustment is lockable. The facing fittings are provided with a coupling bolt, oriented horizontally and spaced apart from the back side of the facing, and these coupling bolts are capable of being introduced into insertion receptacles of front fixation units, which insertion receptacles are mounted on the end of the side walls of the drawer. The front fixation units have vertical adjustment elements, so that the vertical adjustment of the insertion receptacles of the front fixation units and the intended adjustment of the lateral adjustment elements is variable in order to vary the horizontal lateral adjustment of the insertion receptacle of the front fixation units relative to the coupling bolts of the facing fittings, as DE 2014 002 229 U1 shows. There, the vertical adjustment elements and the lateral adjustment elements are no longer accessible and adjustable once the drawer has been assembled.

It is the object of the invention to further refine the facing fittings and the connection fitting parts in such a way that they form a front fixation unit which enables an adjustment in height as well as a horizontal shift in the insertion receptacles for the facing fittings, in order that with the drawer pushed in, the facing can be aligned vertically exactly in the furniture carcass, and the lateral adjustment can be aligned exactly.

The stated object is attained by the features of claim 1.

This is attained according to the invention that the front fixation units are connectable via wooden casing adapters to wooden casing portions, which in the connected state form the side walls of the drawer and are fixedly connected to the drawer bottom; that the front fixation units are accommodated in a separate housing, and the housings are coverable by means of masking caps, which are flush with the outer cross sections of the wooden casing portions and the open face end of the drawer; that the front fixation units are connected fixedly via the housings to the side edges, facing toward one another, of the drawer bottom; and that the vertical adjustment elements and the lateral adjustment elements are accessible via recesses in the housings.

In this way, the facing itself, when the drawer has been assembled, can be oriented exactly in height and laterally in the furniture carcass, and the appearance of the piece of furniture can thus be optimized.

Advantageous embodiments of the fastening fitting can be learned from the dependent claims.

In order that the connection fitting parts can be installed optimally in the side walls of the drawer, the invention provides that the connection fitting parts, that is, the front fixation units, are connected via wooden casing adapters to wooden casing portions, which in the connected state form the side walls of the drawer and are firmly connected, for instance being glued or screwed, to the drawer bottom. The front fixation units are accommodated in a separate housing, and the housings are covered with masking caps, which are flush with the outer cross sections of the wooden casing portions and the open face end of the drawer.

The front fixation units are connected fixedly via the housings to the side edges, facing toward one another, of the drawer bottom, and the vertical adjustment elements and the lateral adjustment elements are accessible via recesses in the housings.

So that the facing can be connected and fixed to the front fixation units solely by being mounted on the open face end of the drawer, the front fixation units are embodied such that the connection fitting parts of the front fixation units have rotatably supported tuck bars with a guide slot as an insertion receptacle for the coupling bolts of the facing fittings; that upon mounting of the facing the coupling bolts are aligned with the insertion receptacles of the guide slots of the tuck bars, and upon further insertion of the coupling bolts into the insertion receptacles of the front fixation units, the tuck bars can be placed rotatably and limitedly horizontally displaceably in a connection position, in which the facing rests on the open face end of the drawer, and that the tuck bars are thereupon lockable in the connection positions reached. In this way, the assembly of the facing and the drawer open at the face end can be completed solely by joining the facing fittings and the front fixation units of the drawer in an aligned manner. Furthermore, fastening the facing to the drawer can be undone again in a simple way because the facing, with the locking of the tuck bars undone, can be removed from the locking of the tuck bars from the connection position from the drawer, and the tuck bars can be retracted, rotated back into the insertion position, and fixed again in the insertion position.

The tuck bar is supported rotatably on a support plate, and the rotary bearing is formed by a gate bolt, which is limitedly horizontally adjustable in a horizontal slot in the support plate. The rotary bearing of the tuck bar can thus be displaced from the insertion of the coupling bolt of the facing fitting into the connection fitting part of the drawer until the connection position of the coupling bolt is reached.

Furthermore, the support plate is limitedly vertically adjustable on a base sheet, which is fixed nondisplaceably on the outside of a side wall of the drawer, and the spacing of the support plate from the face end of the drawer to the spacing of the coupling bolt of the facing fitting from the back side of the facing is selected such that the rotated and displaced tuck bar has reached its connection position once the facing rests on the face end of the drawer.

The tuck bar in the connection position, with its upper part of the guide slot, engages the coupling bolt of the facing fitting introduced into the connection fitting part of the drawer from behind. The gate bolt of the tuck bar is additionally guided in a curved guide slot of a gate plate, so that the gate plate, upon the adjustment of the gate bolt in the guide slot of the gate plate, leads to a limited vertical adjustment of the gate plate upward and locks the tuck bar in the connection position reached. A compression spring with a guide bolt then firmly maintains the position of the gate plate on the support plate. The compression spring is supported on angled parts of the support plate and of the gate plate.

The adjustment of the support plate on the base sheet is achieved in that the support plate is limitedly vertically adjustable by means of two stamped-out and bent-out tabs into two elongated openings of the base sheet that are located vertically one above the other.

The gate plate is guided adjustably on the support plate by angled parts which engage elongated openings in the support plate; one part of the gate plate engages one opening from behind with a crossbar and with another angled part engages the other opening of the support plate from behind and they thus firmly hold the gate plate on the support plate.

Calibration and an exact alignment of the connection fitting parts are made possible in that the support plate receives the lateral adjustment element, which is provided with a threaded end, in a curved horizontal recess. The lateral adjustment element is held by a fork of the recess that diametrically engages the threaded end. A rotation of the lateral adjustment element varies the lateral position of the support plate relative to the base sheet.

The base sheet additionally has an oval receptacle for the vertical adjustment element, which element supports an eccentrically located bearing bolt that is introduced into a bore of the support plate. Upon a rotation of the vertical adjustment element, the vertical position between the support plate and the base sheet is varied.

The base sheet is braced on the outside of the side wall of the drawer via angled side walls and thereby creates a free space for receiving the adjustable support plate, the rotatable and adjustable tuck bar, and the adjustable gate plate between the base sheet and the housing of the front fixation unit.

Upon a manual adjustment of the gate plate into the lower vertical final position, the fixation of the coupling bolt of the facing fitting in the connection fitting of the drawer is undone. The facing can then be removed from the drawer, and the coupling bolt can be pulled out of the tuck bar, which has been rotated back and shifted back, and the tuck bar can be locked in the insertion position again.

Figure 2:
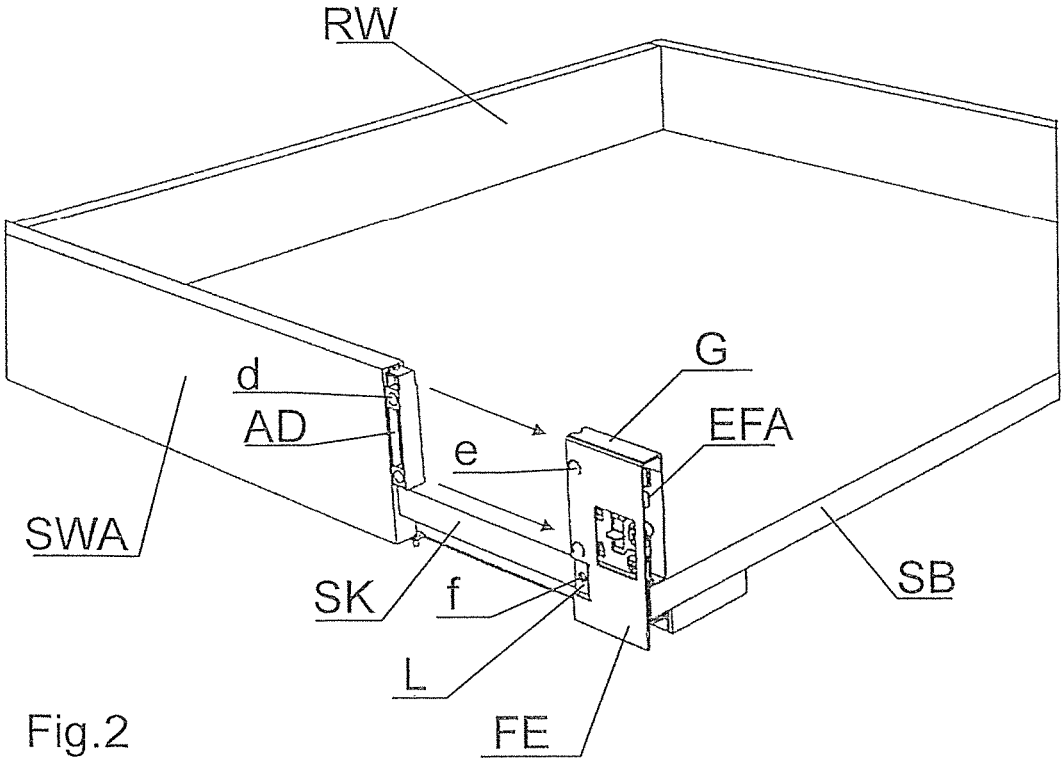
Figure 3:
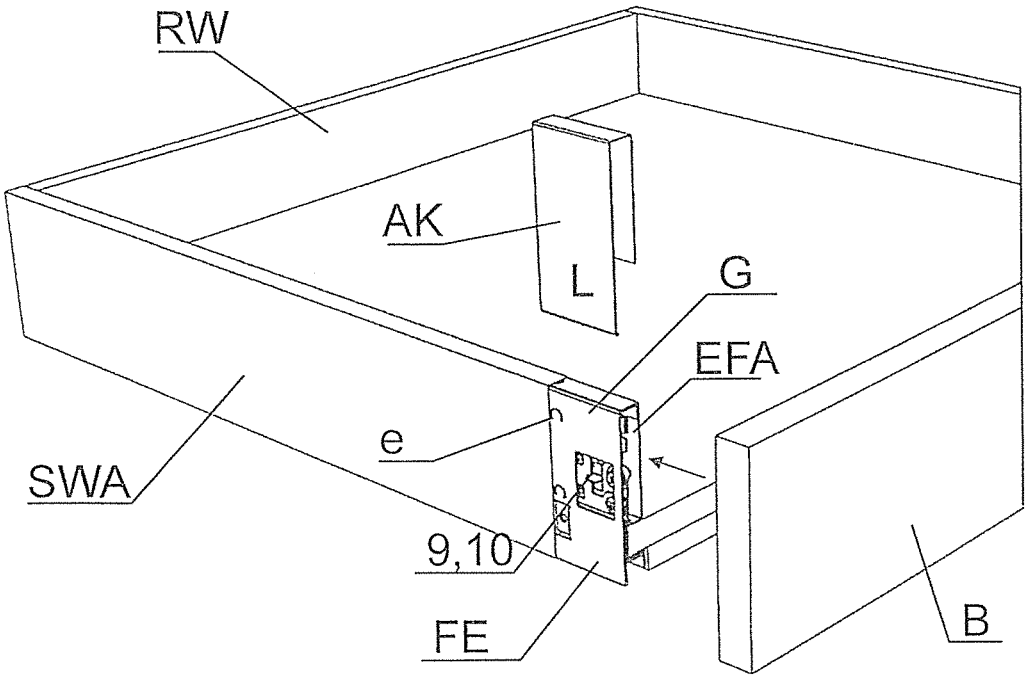
Figure 4:
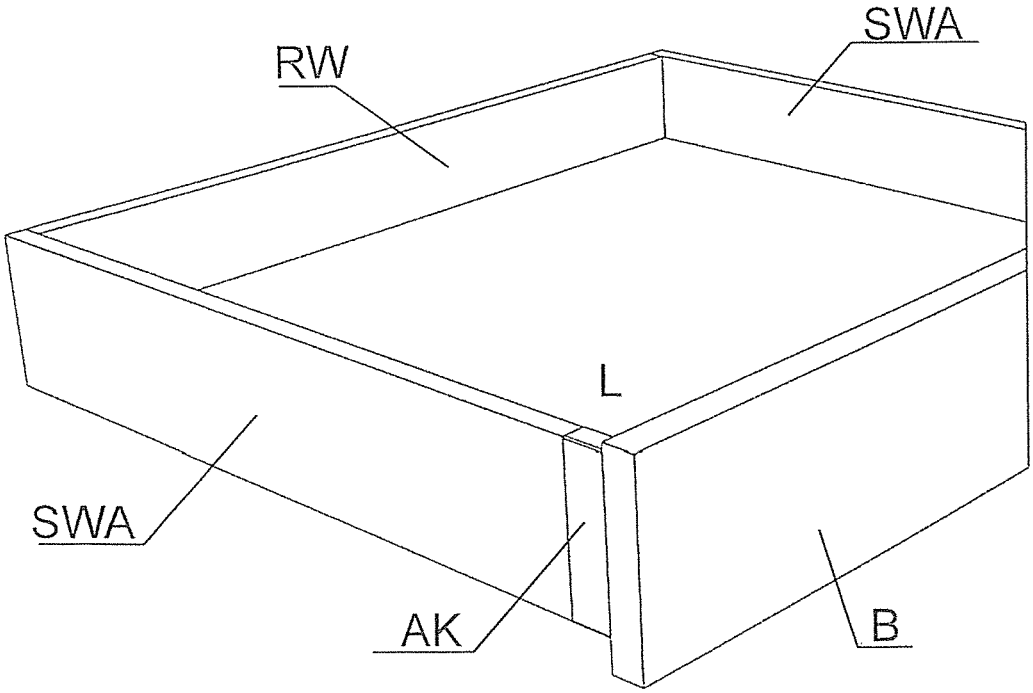
Figure 5:
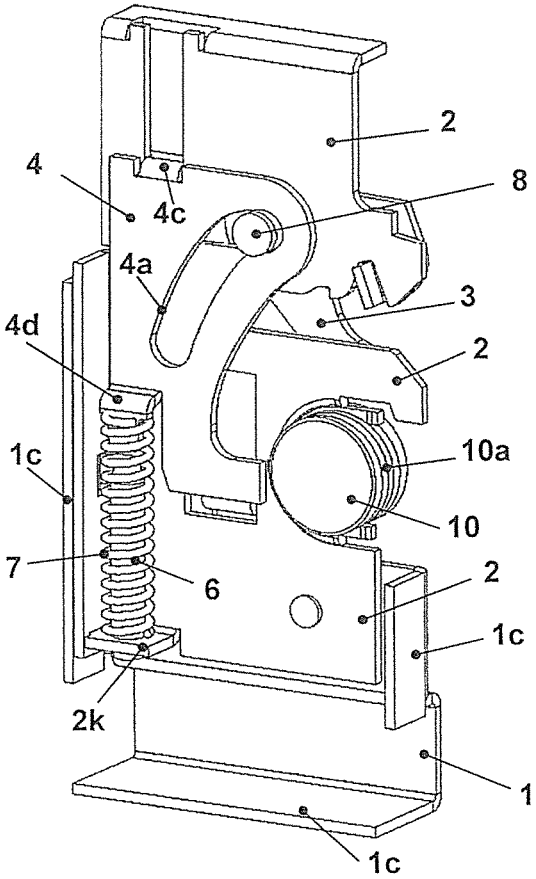
Figure 5:
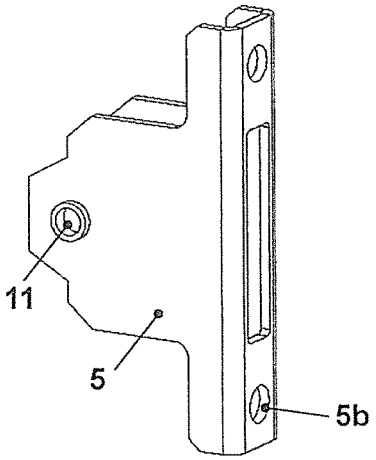
Figure 6:
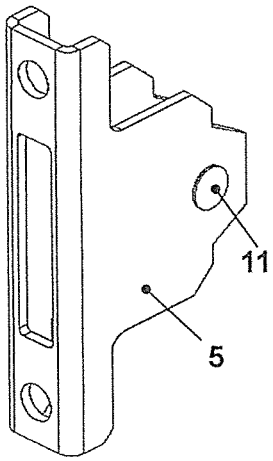
Figure 6:
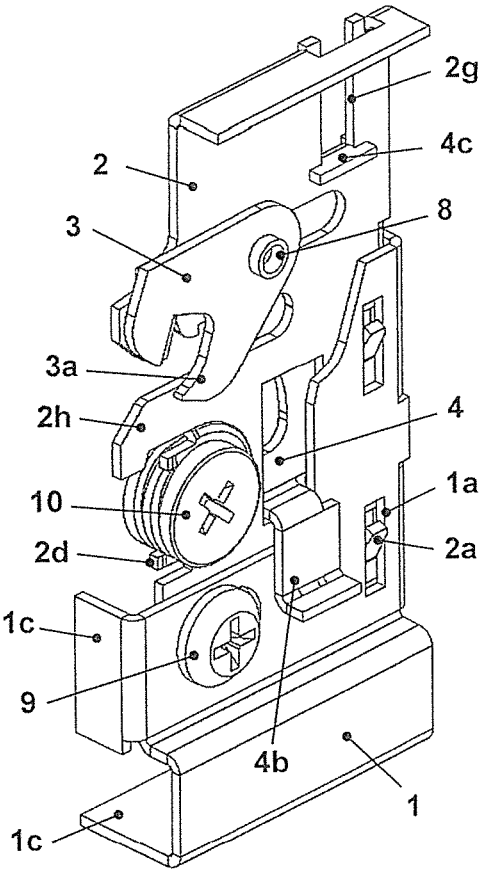
Figure 7:
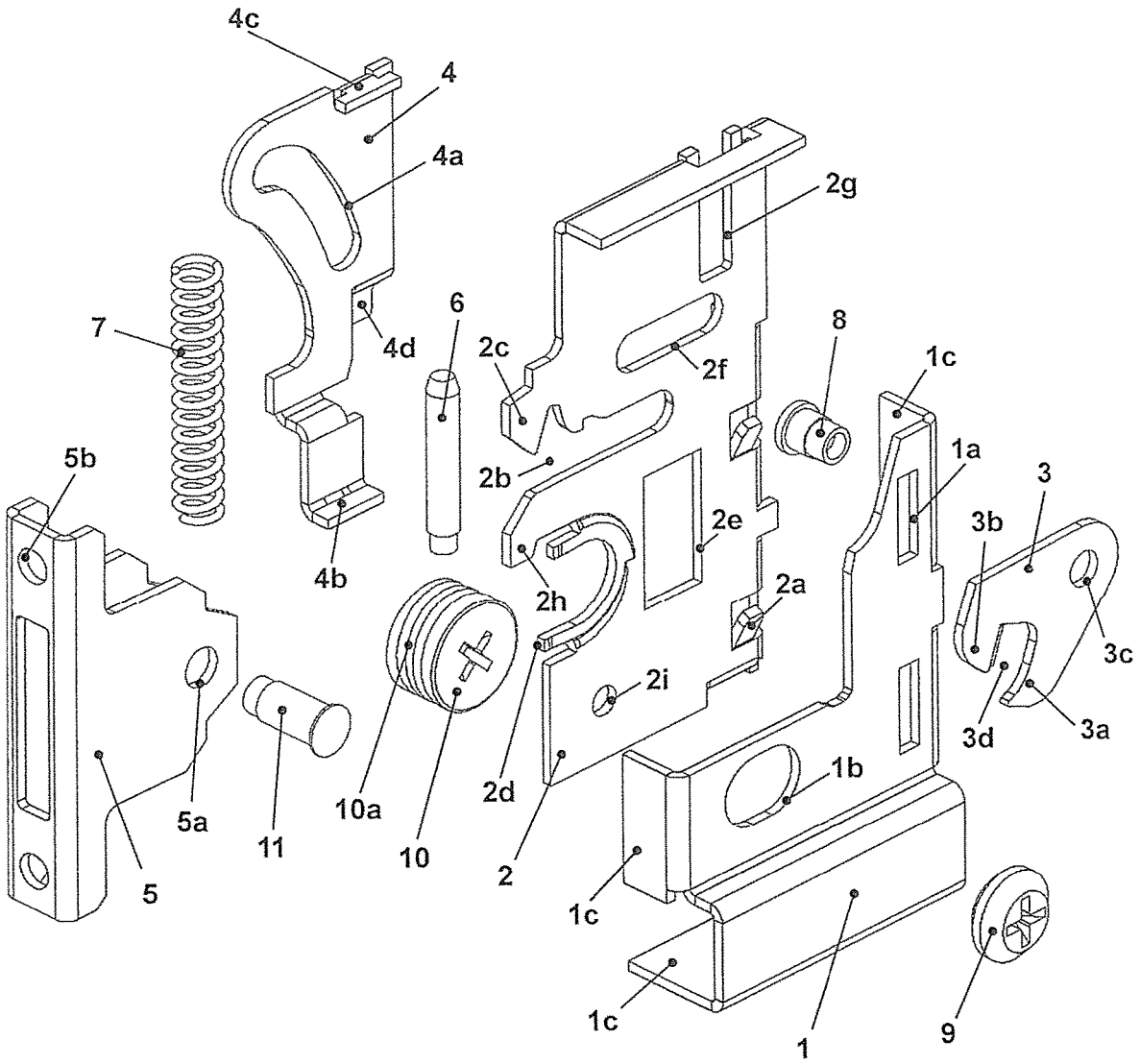
Figure 7A:
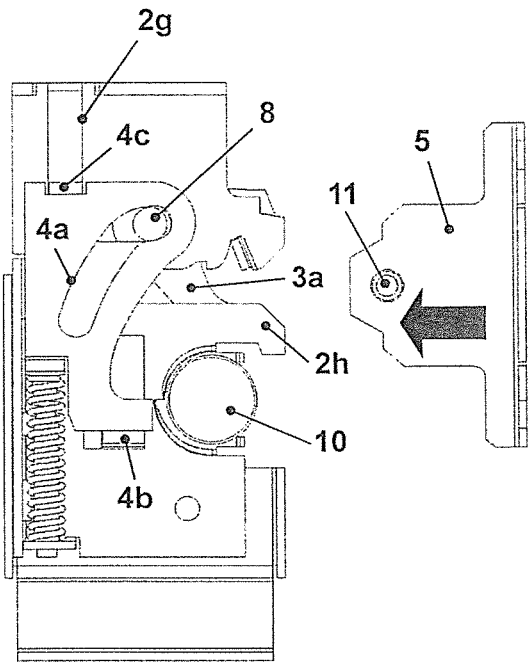
Figure 7B:
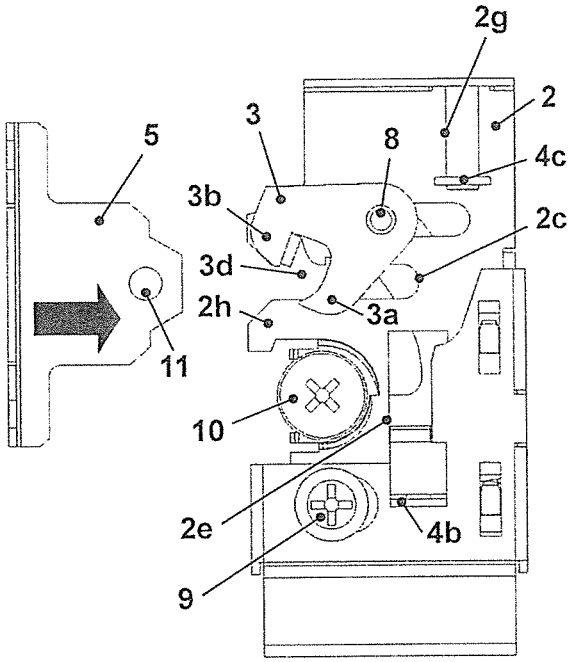
Figure 8A:
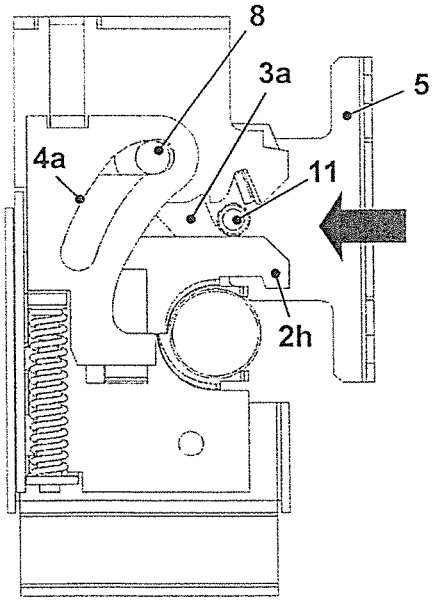
Figure 8B:
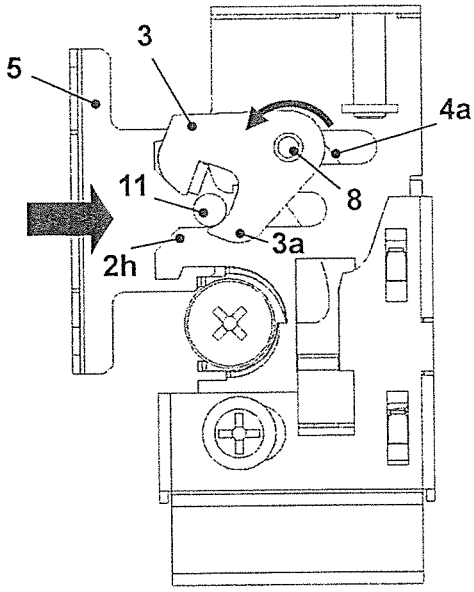
Figure 8:
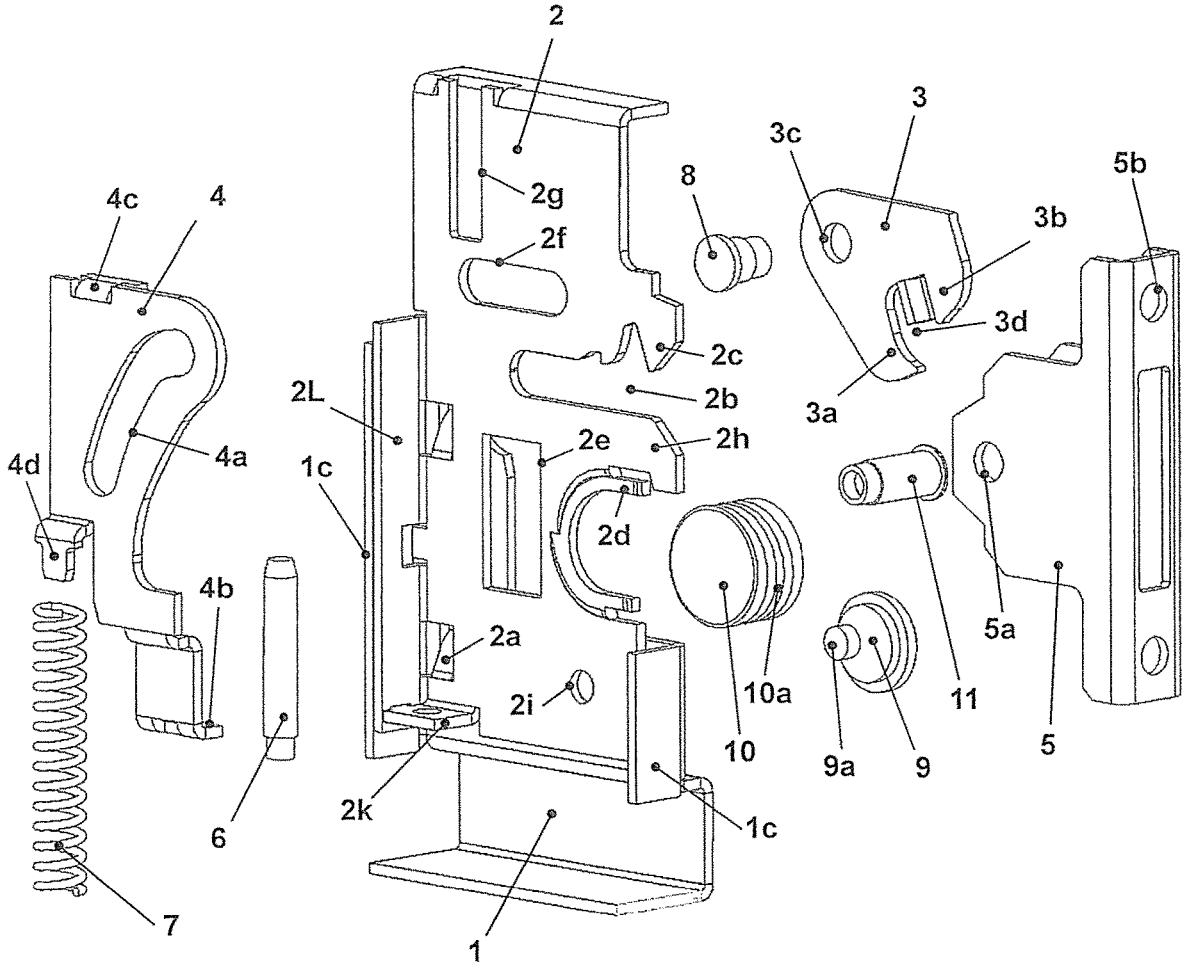
Figure 9A:
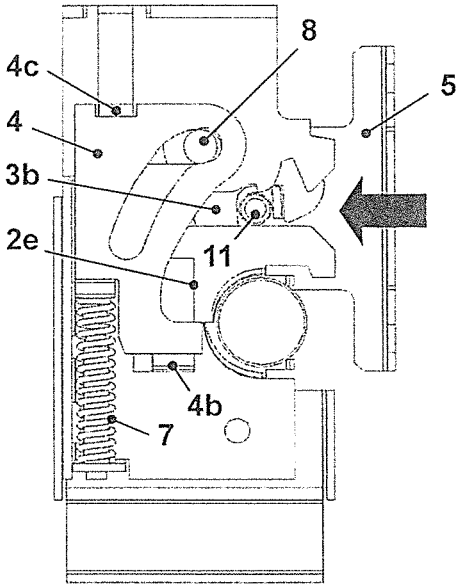
Figure 9B:
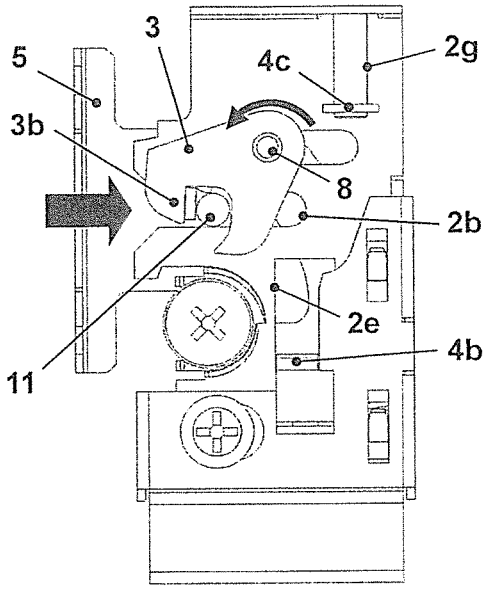
Figure 10A:
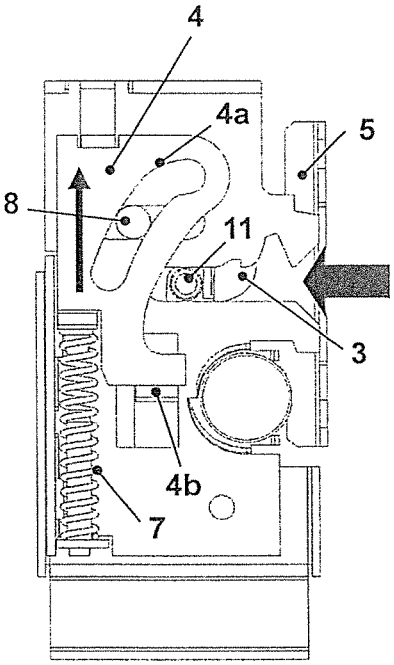
Figure 10B:
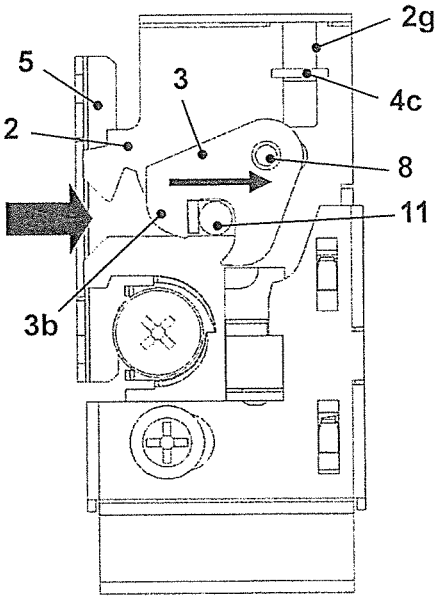
Figure 11:
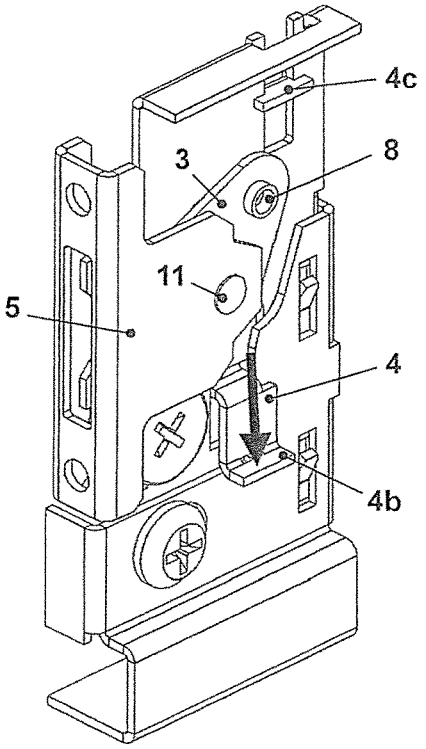
Figure 12:
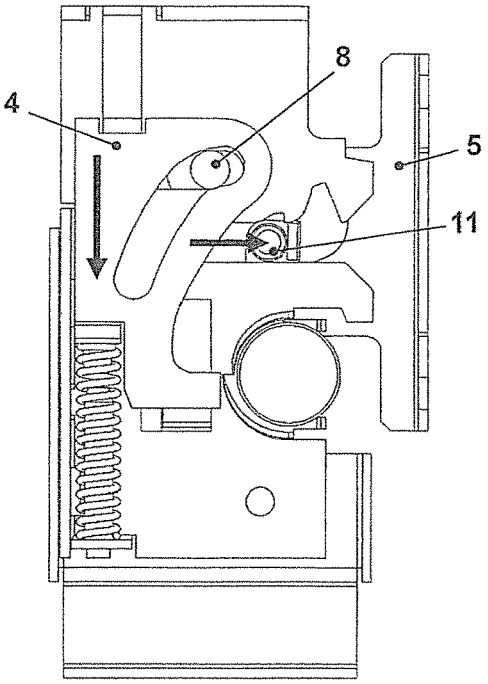
Figure 13:
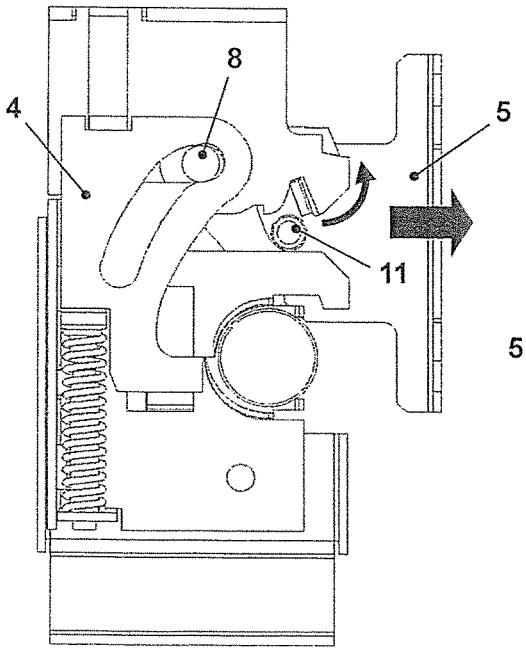
Figure 14:
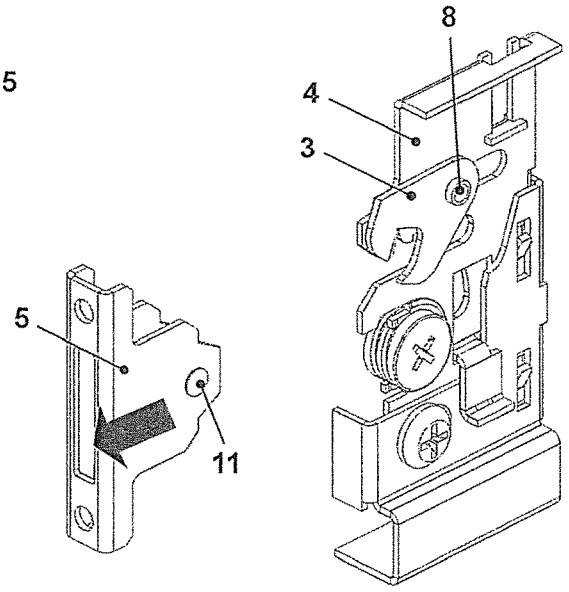

The invention will be described in further detail in conjunction with an exemplary embodiment shown in the accompanying drawings. The drawings show:

FIG. 1, in partial perspective, the left part of an open face end of a drawer with the front fixation unit, a wooden casing adapter and a wooden casing portion in the assembly position;

FIG. 2, in partial perspective, the same part of the open face end of the drawer, in which the housing, with the front fixation unit accommodated in it, is connected to the side edge, oriented toward, of the drawer bottom;

FIG. 3, in partial perspective, the same part of the open face end of the drawer, in which the housing of the front fixation unit is connected to the wooden casing portion and fixedly mounted on the drawer bottom; the masking cap and facing are shown in the assembly position;

FIG. 4, in partial perspective, the same part of the drawer with a fixedly mounted facing; the housing with the front fixation unit is covered by the masking cap;

FIG. 5, in a perspective view, the facing fittings for the facing and the drawer, viewed on the fastening side;

FIG. 6, in a perspective view, the facing fittings for the facing and the drawer, viewed from the side that is visible after assembly;

FIG. 7, the individual parts of the facing fittings in an exploded assembly position, viewed in the direction of FIG. 6;

FIG. 7*a*, the facing assembly part and the fitting part for the drawer, in the alignment position before insertion, viewed in the direction of FIG. 5;

FIG. 7*b*, the facing assembly part and the fitting part for the drawer, viewed in the direction of FIG. 6;

FIG. 8, the individual parts of the facing fittings in an exploded assembly position, viewed in the direction of FIG. 5;

FIG. 8*a*, the facing assembly part and the fitting part for the drawer when the facing assembly part is placed against the fitting part of the drawer, viewed in the direction of FIG. 5;

FIG. 8*b*, the facing assembly part and the fitting part for the drawer when the facing assembly part is placed against the connection fitting part of the drawer, viewed in the direction of FIG. 6;

FIG. 9*a*, the facing fitting and the connection fitting part for the drawer with the motions of the tuck bar upon further insertion, viewed in the direction of FIG. 5;

FIG. 9*b*, the facing fitting and the fitting part for the drawer with the motions of the tuck bar upon further insertion, viewed in the direction of FIG. 6;

FIG. 10*a*, the assembly part and the fitting part for the drawer after reaching the final position and fixation by the gate plate, viewed in the direction of FIG. 5;

FIG. 10*b*, the assembly part and the fitting part for the drawer after reaching the final position and fixation by the gate plate, viewed in the direction of FIG. 6;

FIG. 11, the manually raised facing fittings fixed in the final position, viewed in the direction of FIG. 6;

FIG. 12, the manually raised facing fittings fixed in the final position, viewed in the direction of FIG. 5;

FIG. 13, the facing fittings when the facing assembly part is pulled out from the fitting part of the drawer, viewed in the direction of FIG. 5; and FIG. 14, the facing fittings after the removal of the facing from the face end of the drawer, viewed in the direction of FIG. 6.

FIG. 1 shows in partial perspective how a side wall of the drawer is embodied. It includes a front fixation unit FE with an insertion receptacle EFA for the coupling bolt 11 on the back side of the facing B. The front fixation unit FE is accommodated in a housing G, which can be fastened with a tab L that has fastening bores c to the side edge, facing toward it, of the drawer bottom SB. A wooden casing adapter AD is introduced with bolts a into bores b of the wooden casing portion SWA and firmly connected, for instance glued, firmly to it.

The drawer thus prepared is shown in FIG. 2; the housing G with the front fixation unit FE and the wooden casing portion SWA form the side wall of the drawer, which is firmly connected to the drawer bottom SB, for instance being glued or screwed to it, as FIG. 3 shows. The housing G with the front fixation unit FE is flush with the open face end of the drawer. The facing B now needs only to be aligned, with its coupling bolts 11, with the insertion receptacles EFA of the front fixation units FE and pushed in. All the other functions are taken on by the front fixation units FE, as will be shown hereinafter. Since the other side wall is constructed similarly but laterally reversed, the vertical adjustment elements 9 and the lateral adjustment elements 10 are accessible in the housing G via the recesses A. In the final inserted position of the drawer, the facing can thus be aligned exactly, so that in the furniture carcass it presents a visually clean image for the front side of the piece of furniture.

As FIG. 4 shows, the front fixation units FE, after the alignment of the facing B, are covered with masking caps AK, which are flush with the outer cross sections of the wooden casing portions SWA and the open face end of the drawer. The housing G of the front fixation unit FE has stamped-out tabs L, which when the housing G has been thrust onto the wooden casing adapter AD are bent into receptacles d of the wooden casing adapter AD and thus establish a firm connection of the housing G with the front fixation unit FE and the wooden casing portion SWA (FIG. 2).

In FIG. 5, a fitting part for the drawer is shown in perspective; the view is directed to the fastening side, facing toward the side wall of the drawer. The facing fitting 5 is screwed via the bores 5*b* to the back side of the facing. The coupling bolt 11 connects the two legs of the facing fitting 5, embodied in bracket-like form, in a predetermined spacing from the back side of the facing. The facing of the drawer has two such facing fittings at a spacing which is adapted to the size of the face ends of the two side walls of the open face end of the drawer having the front fixation units FE.

FIG. 6 shows the two fitting parts in a top view in the opposite direction. The connection fitting part for the drawer, as a front fixation unit FE, comprises a base sheet 1, a support plate 2, a rotatably supported tuck bar 3, and a gate plate 4. The base sheet 1 has angled side walls 1*c*, which are braced on the outside of the side wall of the drawer and creates sufficient free space between the base sheet 1 and the outside of the side wall of the drawer that the limitedly vertically adjustable support plate 2, the rotatable and displaceable tuck bar 3, and the limitedly vertically adjustable gate plate 4 on the support plate 2 can be accommodated in this free space.

In FIGS. 7 and 8, in viewing directions corresponding to FIGS. 6 and 5, the individual parts of the facing fitting 5 and the connection fitting part for the drawer are shown in an exploded assembly position. In both FIGS. 7 and 8, the individual parts of the facing fitting 5 and of the connection fitting part for the drawer can be seen. The base sheet 1, on its underside and the two vertical sides, has angled side walls 1*c*, which create a free space on the back side of the base sheet 1. On the right-hand vertical side, the base sheet 1 has two elongated openings 1*a*, located one above the other, which stamped-out and outward-bent tabs 2*a* of the support plate 2 engage and in which the tabs are limitedly vertically adjustable. The base sheet 1 furthermore has an oval opening 1*b*, in which the vertical adjustment element 9 can be introduced and guided rotatably; the vertical adjustment element terminates in an eccentrically located guide bolt 9*a*, which is introduced into a bore 2*i* of the support plate 2. With this vertical adjustment element 9, the vertical position between the support plate 2 and the base sheet 1 can be varied by means of rotation. The support plate 2 has a curved, horizontal recess, in which a fork 2*d* is secured that diametrically surrounds a threaded end 10*a* of the lateral adjustment element 10 and is guided adjustably therein. In this way, by rotation of the lateral adjustment element 10, the lateral position between the base sheet 1 and the support plate 2 can be varied.

A gate bolt 8 of the tuck bar 3 is introduced through a curved guide slot 4*a* of a gate plate 4 and a horizontal elongated opening 2*f* of the support plate 2 into the bearing bore 3*c* of the tuck bar 3. This tuck bar 3 is thus rotatable on the support plate 2 and is horizontally displaceable in the opening 2*f*. The tuck bar 3 has a guide slot 3*d*, which is formed by a lower part 3*a* and an upper part 3*b* of the tuck bar 3. The tuck bar 3 is rotatable and displaceable on the side of the support plate 2 oriented toward the base sheet 1. On the side of the support plate 2 facing away from the base sheet 1, a gate plate 4 is limitedly adjustable vertically. It is guided with angled ends 4*b* and 4*c* through openings 2*e* and 2*g* of the support plate 2, and by means of a crossbar the end 4*c* engages the opening 2*g* from behind and the angled end 4*b* engages the opening 2*e* from behind. In this way, the gate plate 4 is firmly held on the support plate 2. The gate plate 4 furthermore has an angled end 4*d* on the outside that receives a compression spring 7 with a guide pin 6. The compression spring 7 is braced on a shoulder 2*k* of the support plate 2. The support plate 2 has a horizontally extending guide slot 2*b*, which is bounded at the bottom by a part 2*b* and at the top by a part 2*c* of the support plate 2.

Before the facing is attached to the drawer, the facing fitting 5 and the drawer are aligned with the connection fitting part in the manner shown in FIGS. 7*a* and 7*b* (in the drawings, only one connection point is ever shown).

In this situation, the facing fitting 5 is aligned by the coupling bolt 11 with the insertion receptacle EFA of the guide slot 3*d* of the tuck bar 3. The horizontal slot 2*b* in the support plate 2 lengthens insertion receptacle EFA in the connection fitting part of the drawer toward the insertion side; the lower part 2*h*, dropping off at the front, of the support plate 2 further facilitates the insertion of the coupling bolt 11.

After the facing has been placed against the connection fitting parts of the drawer, the coupling bolt 11 of the facing fitting 5 places itself on the lower part 3*a* of the tuck bar 3. Before that, the exact vertical and lateral positioning of the facing relative to the drawer has been performed by calibration and rotation of the vertical adjustment element 9 and of the lateral adjustment element 10, so that the process of connection between the facing fitting 5 and the connection fitting part on the outside of the side wall of the drawer can begin at the positions that can be seen in FIGS. 8*a* and 8*b*.

As FIGS. 9*a* and 9*b* show, by further insertion of the facing fitting 5 into the connection fitting part on the outside of the side wall of the drawer, the tuck bar 3 is rotated about the gate bolt 8; the upper part 3*b* engages the coupling bolt 11 of the facing fitting 5 from behind. As can learned from FIG. 9*a*, until then the gate plate 4 remains in the lower vertical position; the compression spring 7 is compressed and tensed. The gate bolt 8 of the tuck bar 3 is still located in the upper region of the curved guide slot 4*a* of the gate plate 4 and still maintains the tensed position of the compression spring 7. The two facing fittings of the facing and drawer have almost reached their final position and thus are in the connection position.

As FIGS. 10*a* and 10*b* show, upon the adjustment of the facing for contact with the face end of the drawer, the final position and the connection position of the two individual parts of the fastening fitting is reached. The gate bolt 8 of the tuck bar 3 has been thrust horizontally in the horizontal slot 2*b* of the support plate 2, without undertaking any further rotation. Furthermore, the gate bolt 8 of the tuck bar 3 has been displaced downward in the guide slot 4*a* of the gate plate 4, which leads to the relaxation of the compression spring 7, as can be seen in FIG. 10*a*. The upwardly adjusted gate plate 4 prevents the coupling bolt 11 of the facing fitting 5 from being pulled out of the slot 2*b* of the support plate 2 and thus also prevents a reversal and rotation backward of the tuck bar 3.

If the facing is removed from the face end of the drawer, then on the accessible visible side of the connection fitting part of the drawer, a pressure downward is exerted, for instance by means of a screwdriver, on the part 4*b* guided by the support plate 2, as FIG. 11 shows.

Then, as FIG. 12 shows, the compression spring 7 is tensed again, and the gate bolt 8 of the tuck bar 3 is pushed somewhat out of the horizontal slot 2*b* of the support plate 2. The gate bolt 8 of the tuck bar 3 is held in the lower position by the upper horizontal end of the guide slot 4*a* and thus by the gate plate 4. The compression spring 7 is tensed, and the gate plate 4 enables the continued removal of the facing from the drawer.

As FIG. 13 shows, in the process the tuck bar 3 is rotated back into its insertion position and maintains that position when the facing fitting 5 is separated from the fitting part of the drawer, as FIG. 14 shows.

It must also be mentioned that the construction of the left side wall SW of the drawer is the same; however, the front fixation unit FE is introduced laterally reversed into the side wall of the drawer, so that the insertion receptacle EFA is again facing toward the back side of the facing B, and the housing G of the front fixation unit FE has the recess A on the outside of the side wall SW, in order to gain access to the vertical adjustment element 9 and the lateral adjustment element 10.

In particular, the side wall "SWA" comprises glass, metal, wood, stone, etc.

The connecting part "AD" can be inserted, as is done with wood. However, it could also be glued to SWA or snapped on, or it could take the form of any other mechanically releasable or nonreleasable connection.

The part "AD" can equally be integrated with the unit "X" in a releasable, glued, or nonreleasable manner. It could also be that no part "AD" is required; in that case, the connection in the unit "X" would already be a part of that unit.

In other words, the part "AD" is not necessarily required, but can be required. In that case, the details of the receptacle would simply already exist in the unit "X" (for example, as a plate, bent over double, with corresponding detail).

What is important overall is that the dresser drawer guide is separate and not necessarily connected to the side wall "SWA" and to the unit "X" and/or part "AD".

The invention claimed is:

1. A fastening fitting for a facing (B) on an open side of a drawer, which fitting comprises two facing fittings (5) mounted on the back side of the facing (B) and two connection fitting parts mounted, in the vicinity of the open face end of the drawer, on the side walls (SW) of the drawer; that the facing fittings (5) are provided with a horizontally oriented coupling bolt (11) spaced apart from the back side of the facing (B), which coupling bolts can be introduced into insertion receptacles (EFA) of front fixation units (FE); and that the front fixation units (FE) have vertical adjustment elements (9) for varying the vertical adjustment of the insertion receptacles (EFA) of the front fixation units (FE) and lateral adjustment elements (10) for varying the horizontal lateral adjustment of the insertion receptacles (EFA) of the front fixation units (FE) relative to the coupling bolts (11) of the facing fittings (5), the vertical adjustment of the facing (B) connected to the connection fitting parts is variable and lockable; front fixation units (FE) are mounted on the end of the side walls (SW) of the drawer; the front fixation units (FE) are connectable via wooden casing adapters (AD) to wooden casing portions (SWA), which in the connected state form the side walls of the drawer and are fixedly connected to the drawer bottom (SB); the front fixation units (FE) are accommodated in a separate housing (G), and the housings (G) are coverable by means of masking caps (AK), which are flush with the outer cross sections of the wooden casing portions (SWA) and the open face end of the drawer; the front fixation units (FE) are connected fixedly via the housings (G) to the side edges, facing toward one another, of the drawer bottom (SB), and the vertical adjustment elements (9) and the lateral adjustment elements (10) are accessible via recesses (A) in the housings (G);

the connection fitting parts of the drawer have tuck bars (3), which are rotatable and limitedly displaceable and have a guide slot (3*d*) as an insertion receptacle (EFA) for the coupling bolts (11) of the facing fittings (5); when the facing (B) is attached, the coupling bolts (11) are aligned with the insertion receptacles (EFA) of the front fixation units (FE), that is, with the guide slots (3*d*) of the tuck bars (3), and upon further insertion of the coupling bolts (11) into the connection fitting parts, that is, into the front fixation units (FE), the tuck bars (3) can be put rotatably and horizontally displaceably into a final and connecting position; in the connection position, the facing rests with its back side on the face end of the drawer, and the coupling bolts (11) of the facing fittings (5) are locked in captive fashion in the connection position in the connection fitting parts of the drawer, that is, the front fixation units (FE);

the facing, when the locking of the coupling bolts (11) of the facing fittings (5) and tuck bars (3) is undone, can be removed out of the connected position from the face end of the drawer, and the tuck bars (3) can be retracted, rotated back into the insertion position, and in the insertion position can be locked again;

the tuck bar (3) is rotatably supported on a support plate (2), and the rotary bearing is formed by a gate bolt (8), which is limitedly horizontally adjustable in a horizontal slot (2*f*) of the support plate (2); the support plate (2) is limitedly vertically adjustable on a base sheet (1), which is nondisplaceably fixed on the outside of a side wall of the drawer, and the spacing of the support plate (2) from the face end of the drawer to the spacing of the coupling bolt (11) of the facing fitting (5) toward the back side of the facing (B) is selected such that the gate bolt (8) of the tuck bar (3), in its rotated and displaced position, assumes the connected position when the facing (B) rests on the face end of the drawer;

the tuck bar (3) in the connection position, with an upper part (3*b*) of the guide slot (3*d*), engages the coupling bolt (11) of the facing fitting (5) introduced into the connection fitting part of the drawer from behind; the gate bolt (8) of the tuck bar (3) is additionally guided in a curved guide slot (4*a*) of a gate plate (4), and the guide slot (4*a*) of the gate plate (4) leads to a limited vertical, upward-oriented adjustment of the gate plate (4) on the support plate (2), which locks the tuck bar (3) in the connection position; and a compression spring (7) on a guide bolt (6) firmly maintains the upper position of the gate plate (4) on the support plate (2), and the compression spring (7) is braced by the guide bolt (6) on angled parts (2*k*, 4*b*) of the support plate (2) and of the gate plate (4) and firmly holds the facing (B) with spring tension against the drawer; and the support plate (2) is limitedly vertically adjustable via two stamped-out and bent-out tabs (2*a*) into two elongated openings (1*a*) of the base sheet (1) that are located vertically one above the other;

characterized in that the gate plate (4) is guided vertically adjustably on the support plate (2) by angled parts (4*b*, 4*c*), which engage elongated openings (2*e*, 2*g*) of the support plate (2), and the part (4*b*) engages the opening (2*e*) from behind and the part (4*c*), with a crossbar, engages the support plate (2) from behind and the parts (4*b*, 4*c*) firmly hold the gate plate (4) on the support plate (2).

2. A fastening fitting for a facing (B) on an open side of a drawer, which fitting comprises two facing fittings (5) mounted on the back side of the facing (B) and two connection fitting parts mounted, in the vicinity of the open face end of the drawer, on the side walls (SW) of the drawer; that the facing fittings (5) are provided with a horizontally oriented coupling bolt (11) spaced apart from the back side of the facing (B), which coupling bolts can be introduced into insertion receptacles (EFA) of front fixation units (FE); and that the front fixation units (FE) have vertical adjustment elements (9) for varying the vertical adjustment of the insertion receptacles (EFA) of the front fixation units (FE) and lateral adjustment elements (10) for varying the horizontal lateral adjustment of the insertion receptacles (EFA) of the front fixation units (FE) relative to the coupling bolts (11) of the facing fittings (5), the vertical adjustment of the facing (B) connected to the connection fitting parts is variable and lockable; front fixation units (FE) are mounted on the end of the side walls (SW) of the drawer; the front fixation units (FE) are connectable via wooden casing adapters (AD) to wooden casing portions (SWA), which in the connected state form the side walls of the drawer and are fixedly connected to the drawer bottom (SB); the front fixation units (FE) are accommodated in a separate housing (G), and the housings (G) are coverable by means of masking caps (AK), which are flush with the outer cross sections of the wooden casing portions (SWA) and the open face end of the drawer; the front fixation units (FE) are connected fixedly via the housings (G) to the side edges, facing toward one another, of the drawer bottom (SB), and the vertical adjustment elements (9) and the lateral adjustment elements (10) are accessible via recesses (A) in the housings (G);

the connection fitting parts of the drawer have tuck bars (3), which are rotatable and limitedly displaceable and have a guide slot (3*d*) as an insertion receptacle (EFA) for the coupling bolts (11) of the facing fittings (5); when the facing (B) is attached, the coupling bolts (11) are aligned with the insertion receptacles (EFA) of the front fixation units (FE), that is, with the guide slots (3*d*) of the tuck bars (3), and upon further insertion of the coupling bolts (11) into the connection fitting parts, that is, into the front fixation units (FE), the tuck bars (3) can be put rotatably and horizontally displaceably into a final and connecting position; in the connection position, the facing rests with its back side on the face end of the drawer, and the coupling bolts (11) of the facing fittings (5) are locked in captive fashion in the connection position in the connection fitting parts of the drawer, that is, the front fixation units (FE); and the facing, when the locking of the coupling bolts (11) of the facing fittings (5) and tuck bars (3) is undone can be removed out of the connected position from the face end of the drawer, and the tuck bars (3) can be retracted, rotated back into the insertion position, and in the insertion position can be locked again;

characterized in that the support plate (2) receives the lateral adjustment element (10), which is provided with a threaded end (10*a*), in a curved horizontal recess;

the lateral adjustment element (10) is held by a fork (2*d*) of the recess that diametrically engages the threaded end (10*a*); and the lateral adjustment element (10), upon a rotation, varies the lateral position between the support plate (2) and the base sheet (1).

* * * * *